US008832897B2

(12) United States Patent
Gallardo

(10) Patent No.: US 8,832,897 B2
(45) Date of Patent: Sep. 16, 2014

(54) DUAL-ROLLER PAINT ROLLER

(75) Inventor: Jose Antonio Gallardo, Castaic, CA (US)

(73) Assignee: Arigala Painting, Inc., Castaic, CA (US)

( * ) Notice: Subject to any disclaimer, the term of this patent is extended or adjusted under 35 U.S.C. 154(b) by 13 days.

(21) Appl. No.: 13/547,964

(22) Filed: Jul. 12, 2012

(65) Prior Publication Data

US 2012/0272470 A1 Nov. 1, 2012

Related U.S. Application Data

(63) Continuation-in-part of application No. 12/608,906, filed on Oct. 29, 2009, now Pat. No. 8,365,342.

(51) Int. Cl.

| | |
|---|---|
| ***B05C 1/08*** | (2006.01) |
| ***B05C 17/02*** | (2006.01) |
| ***B44D 3/12*** | (2006.01) |

(52) U.S. Cl.

CPC ..... *B05C 17/0207* (2013.01); *B05C 17/023* (2013.01); *B05C 17/0245* (2013.01); *B44D 3/126* (2013.01)

USPC ..... 15/230.11; 492/19

(58) Field of Classification Search

USPC ..... 15/230.11; 492/17, 19

See application file for complete search history.

(56) References Cited

U.S. PATENT DOCUMENTS

| | | | | |
|---|---|---|---|---|
| 183,282 | A | | 10/1876 | Carr |
| 191,318 | A | | 5/1877 | Cross |
| 668,069 | A | | 2/1901 | Unger |
| 2,467,010 | A | | 4/1949 | Coley |
| 2,611,914 | A | | 9/1952 | Vanasse |
| 2,694,874 | A | | 11/1954 | Coolidge, Jr. et al. |
| 2,731,657 | A | | 1/1956 | Ogren |
| 2,788,539 | A | | 4/1957 | Santina |
| 2,863,245 | A | | 12/1958 | Knapp, Jr. |
| 3,310,831 | A | | 3/1967 | Brinker |
| 3,430,286 | A | | 3/1969 | Bownes |
| 3,450,140 | A | | 6/1969 | Vail |
| 3,593,361 | A | | 7/1971 | Welt |
| 3,745,624 | A | | 7/1973 | Newman |
| 4,320,553 | A | | 3/1982 | Charles |
| 4,402,102 | A | | 9/1983 | Al-Samman |
| 4,644,604 | A | | 2/1987 | Kierce |
| 4,868,946 | A | | 9/1989 | Marino et al. |
| 5,490,303 | A | * | 2/1996 | Graves ..... 15/230.11 |
| 5,713,095 | A | | 2/1998 | Wakat |
| 5,779,610 | A | | 7/1998 | Weihrauch |

(Continued)

FOREIGN PATENT DOCUMENTS

DE 3813939 A1 11/1989

*Primary Examiner* — Laura C Guidotti
(74) *Attorney, Agent, or Firm* — Kelly & Kelley, LLP

(57) ABSTRACT

An improved dual paint roller frame has a pliers-like construction to allow for roller covers to be moved closer together or farther apart depending upon the surface to be painted. Dual-roller covers are disposed on pivotable roller arms such that the relative angle of one roller cover to the other roller cover can be adjusted depending upon the surface to be painted. The pivot point of the pliers-like construction is switchable such that the pliers selectively apply complementary or opposite movement to the roller covers. A roller cover lock allows the paint roller to function with different sizes of roller covers. An end cap may include an adjustable length roller guide to bias the roller arms away from walls, window sills and the like.

23 Claims, 16 Drawing Sheets

(56) References Cited

U.S. PATENT DOCUMENTS

| | | | |
|---|---|---|---|
| 5,966,772 | A | 10/1999 | Woodnorth et al. |
| 5,967,041 | A | 10/1999 | Schoenert et al. |
| 5,970,568 | A | 10/1999 | Mulcahy, Sr. |
| 5,983,437 | A | 11/1999 | Wakat |
| 6,238,740 | B1 | 5/2001 | Janssen |
| 6,284,318 | B1 | 9/2001 | Jackson |
| 6,681,438 | B2 | 1/2004 | Newman et al. |
| D549,966 | S | 9/2007 | Caldwell |
| 7,600,471 | B2 | 10/2009 | Westby |
| 2002/0122893 | A1 | 9/2002 | Tramont |

* cited by examiner

DUAL-ROLLER PAINT ROLLER

FIELD OF THE INVENTION

The present invention relates generally to paint rollers. More particularly this invention relates to bifurcated paint rollers used with variable length roller covers.

BACKGROUND OF THE INVENTION

U.S. Pat. No. 5,713,095 shows a roller that is manufactured from two conventional rollers, using two conventional frames. Prior to welding the two conventional frames together, one of the conventional frames is cut below the handle and such handle is thrown away, contributing to the expense of the bifurcated roller. U.S. Pat. No. 5,970,568 shows a bifurcated roller which always presents the roller covers in the same plane and the same orientation. Accordingly, the bifurcated roller is limited in the patterns and surfaces that it is capable of printing. Moreover, this bifurcated roller includes an excessively long open space or slot between the rollers. This length wastes the framing rods which form the slot. Further, the size of the slot is not adjustable such that the bifurcated rollers can be moved farther apart of closer together.

U.S. Pat. No. 5,970,568 also shows a bifurcated paint tray. The drawback of this paint tray is that the wall or barrier that bifurcates the paint tray into two receptacles if permanently attached such that the paint tray is not compatible with non-bifurcated rollers. This permanence requires that a person have at least two paint trays—one that is compatible with a bifurcated roller and one that is compatible with a single roller. Accordingly, there is a need for an improved bifurcated paint tray that is compatible with both types of rollers.

In addition, paint stencils are known wherein a person may paint a pattern on a surface using a roller. In one form, a person uses a flat stencil that has a cut-out corresponding to a positive image of the pattern to be printed. This stencil is secured to a surface and then painted over. Usually, such stencils must be moved around or repeatedly placed to form a desired pattern. In another form, rollers are presented with knap that is configured in the pattern to be painted, i.e., devoid of knap in the places of the pattern that are not to be painted. This configuration is limited in that a different roller cover needs to be purchased for each different pattern that a person may way to paint.

Paint roller frames are known that accommodate roller covers of different lengths and diameters by utilizing two support arms at either end of the roller cover. (See e.g., U.S. Pat. No. 3,310,831; U.S. Pat. No. 3,593,361; U.S. Pat. No. 4,868,946; U.S. Pat. No. 6,681,438).

The primary drawback of such prior paint rollers is that there is no way to accommodate roller covers of different sizes on a standard cantilevered roller arm. Thus, there exists a need for a way to support and retain paint rollers of variable lengths and diameters on a single arm paint roller.

Moreover, there exists a continuing need for several further improvements in and to paint rollers. The present invention fulfills these needs and provides further related advantages.

SUMMARY OF THE INVENTION

The present invention is directed to an improved dual paint roller frame that can be used with paint rollers of different lengths and diameters. The improved dual paint roller frame comprises first and second levers connected at a pivot point. Each of the first and second levers has a handle disposed at a first end thereof and a roller arm extending from a second end thereof. The pivot point is disposed at a point between the first and second ends of the levers.

The dual paint roller frame includes a pair of roller covers. Each roller cover is rotatably disposed on one of the roller arms of the first and second levers. The roller covers are preferably made from an absorbent material comprising fabric, foam, lamb's wool or mohair. The roller covers on the lever are replaceable with another roller cover.

End caps are disposed at the ends of the roller covers. The end caps can be smooth or notched. Alternately, the end caps can comprise an absorbent covering in the same material as the roller cover. The end caps are preferably fitted with an adjustable length roller guide that allows for the roller arm to remain biased a certain distance away from a wall, window sill, chair rail, or the like. The adjustable length roller guide ensures that paint from the roller cover is not accidentally applied in an undesirable location.

The roller arms are independently pivotable about longitudinal axes of the respective first and second levers. Each roller arm is independently pivotable through a range of zero degrees to ninety degrees with respect to the first or second lever. A pivot lock is preferably included on the second end of each of the first and second levers. Each of the pivot locks firmly holds the roller arms on either the first or second lever at a particular angle of rotation. The roller arms are also independently extendable along the longitudinal axes of the respective first and second levers with the pivot locks configured to firmly hold the roller arms on either the first or second lever at a particular extension with respect to the first or second lever.

The first and second levers each comprise a first portion corresponding to the first end and a second portion corresponding to the second end. The first and second portions of each lever are functionally connected at the pivot point. The pivot point selectively allows for complementary or opposite movement of the first portion of each lever with respect to the second portion of each lever. A multi-position switch on the pivot point switches the pivot point between complementary or opposite movement. A spring between the first portions of the first and second levers biases the first portions of the first lever away from the second portion of the second lever.

The improved dual paint roller frame may be combined with an inventive paint tray which includes a main paint well having a deep end and a shallow end. The shallow end has an inclined bottom wall that slopes down toward the deep end. A channel is disposed on the back and bottom walls of the deep end and along an adjacent portion of the inclined bottom wall of the shallow end. A divider is configured to be selectively securable to an outside wall of the paint tray. The divider is also configured to be inserted into the channel such that the divider securely engages the channel and divides the deep end and the adjacent portion of the shallow end into two separate receptacles.

In the combination paint roller and paint tray, one of each of the roller arms of the paint roller is dippable into one of the two separate receptacles. The divider has a handle that functions as a spatula tool. The inclined bottom wall has a first pattern in one of the two separate receptacles and a second pattern in the other of the two separate receptacles. A paint tray liner having an integral divider is also configured to be inserted in the main paint well. The paint tray liner with integral divider divides the deep end and the adjacent portion of the shallow end into two separate receptacles.

The present invention is also directed to a stencil tube for use with paint rollers. The stencil tube comprises an elongated hollow tube configured for sliding engagement with a roller cover. An opening in a wall of the elongated hollow tube permits a portion of the roller cover to extend through the opening. The elongated hollow tube remaining around the opening forms a negative image of a pattern to be painted on a surface by the roller cover.

The elongated hollow tube is preferably made from a non-absorbent material comprising plastic or laminated paper. The elongated hollow tube is removable from the roller cover and replaceable with another hollow tube having a different pattern to the opening. The pattern preferably comprises letters, numbers, shapes, or a combination thereof.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
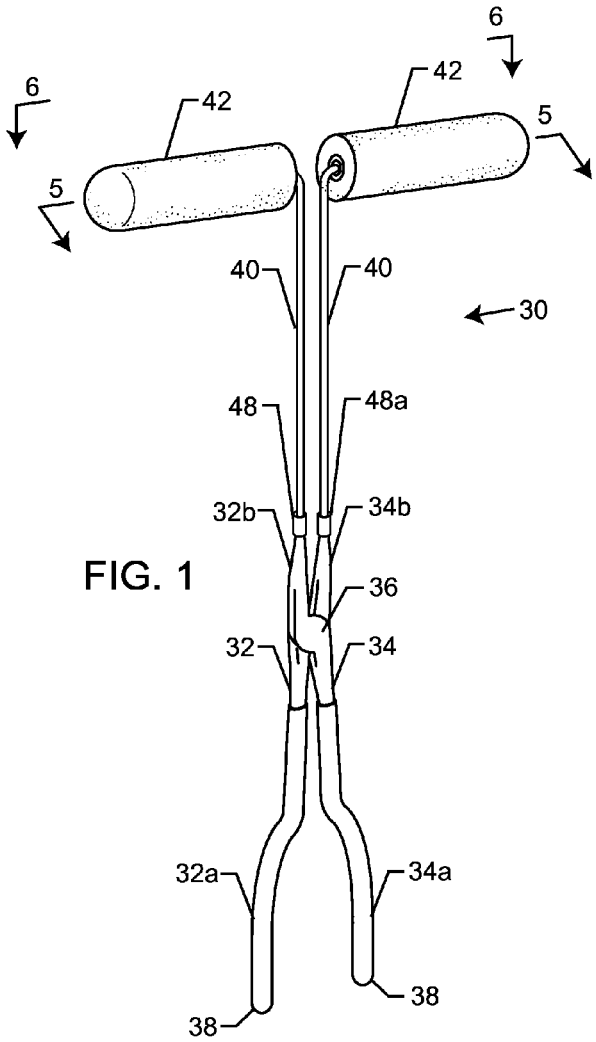
FIG. 1 is a perspective view of the improved dual paint roller frame of the present invention.
Figure 2:
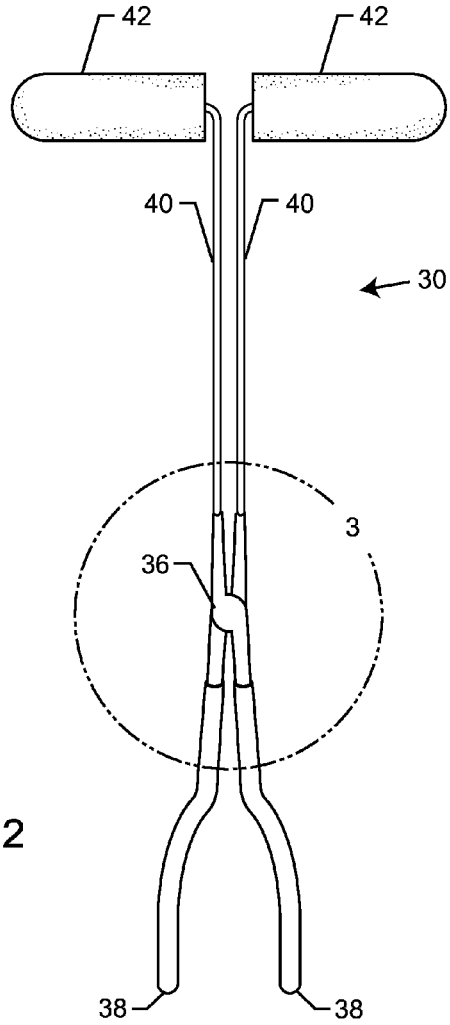
FIG. 2 is a front elevated view of the improved dual paint roller frame of FIG. 1.

As shown in the exemplary drawings, an improved dual paint roller frame, referred to generally in the figures by the reference numeral 30, is provided for more conveniently painting walls, pillars, chairs, fences and other surfaces. As shown in FIGS. 1 and 2, the improved dual paint roller frame 30 comprises a first lever 32 pivotally connected to a second lever 34 at a pivot point 36. The first lever 32 has a first end 32*a* and a second end 32*b*—the first end 32*a* including a handle 38. The second lever 34 also has a first end 34*a* and a second end 34*b*—with the first end 34*a* including a handle 38. A roller arm 40 extends from the second end 32*b*, 34*b* of each of the first and second levers 32, 34. Roller covers 42 are rotatable disposed on the ends of the roller arms 40. The roller covers 42 may comprise any absorbent material commonly used for painting, i.e., fabric, foam, lamb's wool or mohair.

In a preferred embodiment, the pivot point 36 functions to have the first and second levers 32 and 34 function together as would the levers of a pair of pliers. As the handles 38 are moved apart so too are the roller arms 40. Conversely, as the handles 38 are moved closer together so too are the roller arms 40. As with pliers, the farther the pivot point 36 is from the handles 38, the greater the leverage that is exerted on the second ends 32*b*, 34*b* and/or the roller arms 40.

Figure 3:
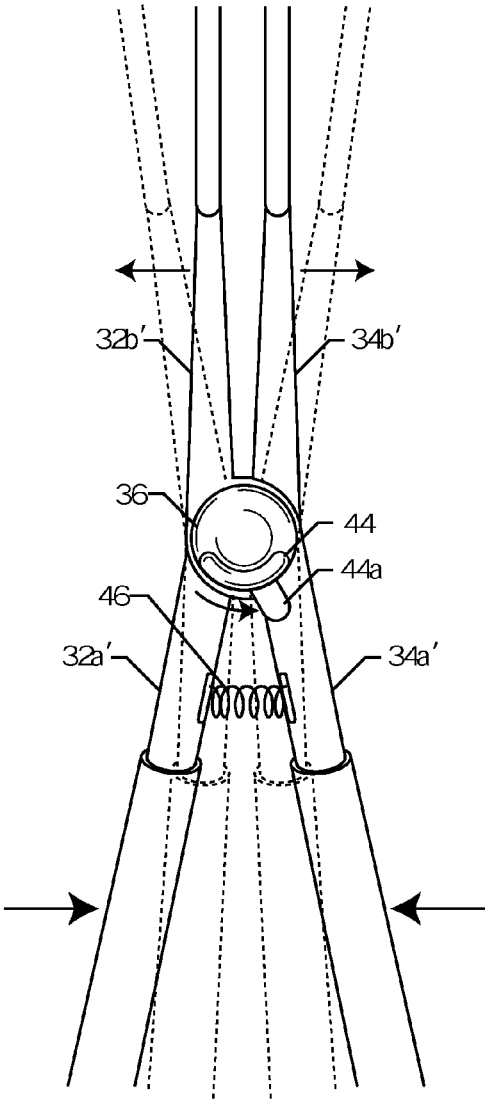
FIG. 3 is an enlarged fragmented view of the area indicated by the line 3 in FIG. 2, illustrating the pivot point of the improved dual paint roller frame of the present invention, wherein the pivot point allows for opposite movement of the first and second levers.
Figure 4:
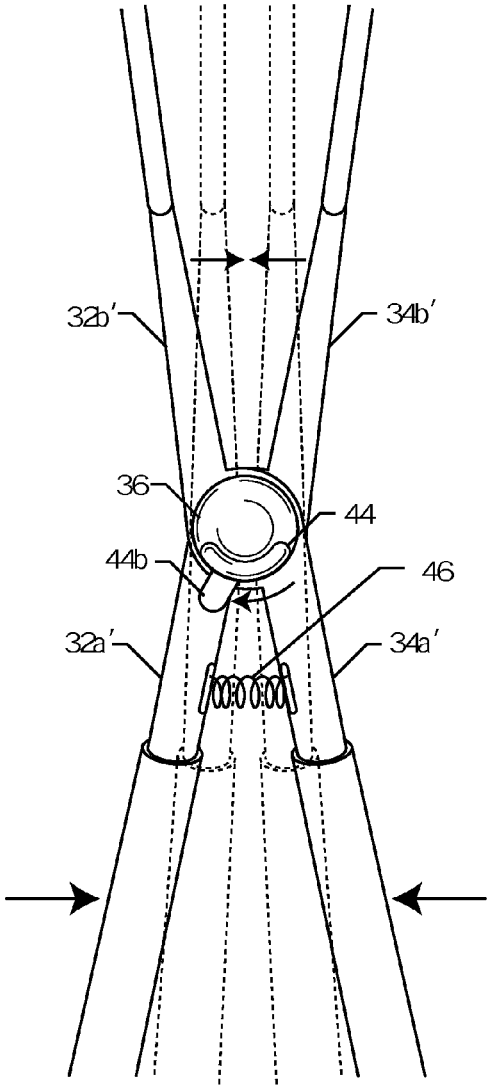
FIG. 4 is similar to FIG. 3, and illustrates the pivot point of the improved dual paint roller frame of the present invention, wherein the pivot point allows for movement of the first and second levers in the same direction.

In particularly preferred embodiment as shown in FIGS. 3 and 4, the pivot point 36 comprises a multi-position switch 44. The first lever 32 comprises a first portion 32*a*' and a second portion 32*b*'. The second lever 34 also comprises a first portion 34*a*' and a second portion 34*b*'. The first portions 32*a*', 34*a*' correspond to the first ends 32*a*, 34*a* described above. The second portions 32*b*', 34*b*' correspond to the second ends 32*b*, 34*b* also described above. In this embodiment, the pivot point 36 operatively connects the first portions 32*a*', 34*a*' to the second portions 32*b*', 34*b*' in such a manner that the position of the multi-position switch 44 determines the functional relationship of the portions. With the switch 44 in a first position 44*a*, the second portions 32*b*', 34*b*' experience opposite movement compared to the first portions 32*a*', 34*a*', i.e., as the handles 38 are moved together, the roller arms 40 move apart. With the switch 44 in a second position 44*b*, the second portions 32*b*', 34*b*' experience complementary movement compared to the first portions 32*a*', 34*a*', i.e., as the handles 38 are moved together, the roller arms 40 also move together. In order to operate the multi-position switch 44, a user must squeeze the handles 38 together prior to moving the switch 44. Squeezing the handles 38 together places the pivot point 36 in a neutral position that allows for the movement of the switch 44. In this embodiment, the improved dual paint roller frame 30 may also comprise a biasing spring 46 between the respective first portions 32*a*', 34*a*' to bias the handles 38 apart.

Figure 5:
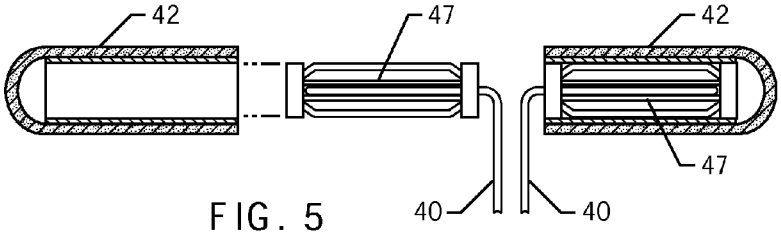
FIG. 5 is a partially sectional view of roller arms and roller covers taken along line 5-5 of FIG. 1.

The roller covers 42 a configured to be disposed onto the ends of the roller arms 40 as is known by those skilled in the art. The roller covers 42 may comprise "large"-type rollers configured to slide over a hollow frame structure 47 rotatably disposed on the roller arms 40, as shown in FIG. 5. Alternatively, the roller covers 42 may comprise "small"-type rollers configured to slide over a single arm with the rotating function included in the roller cover 42 itself rather than on the roller arm (not shown). The roller arms 40 themselves are pivotable through a range of zero to ninety degrees about a longitudinal axis of the respective first and second levers 32, 34. The improved dual paint roller frame 30 also includes a pivot lock 48 disposed at the second end 32*b*, 34*b* of each lever 32, 34. The pivot lock 48 is configured to securely hold the roller arms 40 in a particular angle of rotation. The pivot lock 48 may comprise a sleeve or similar structure that surrounds, in part, the second ends 32*b*, 34*b* and the roller arms 40. The pivot lock 48 may then be secured by the tightening of a set screw 48*a* or similar structure to exert pressure to secure the roller arms 40. Those skilled in the art will be familiar with other structures that will function as the pivot lock 48 is intended to function.

Figure 6:
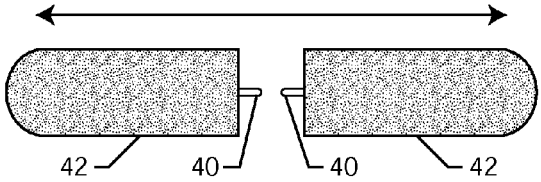
FIG. 6 is a top plan view of the roller arms and roller covers taken along line 6-6 of FIG. 1.
Figure 7:
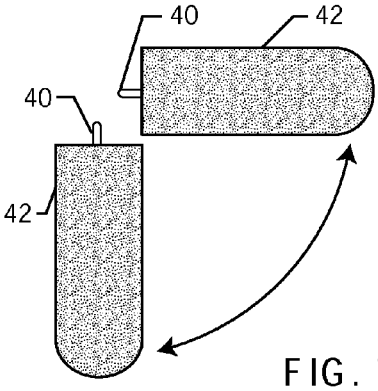
FIG. 7 is a top plan view similar to FIG. 6, illustrating another orientation of the roller arms.
Figure 8:
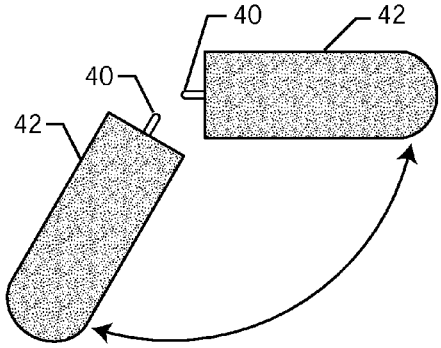
FIG. 8 is a top plan view similar to FIGS. 6 and 7, illustrating yet another orientation of the roller arms.
Figure 9:
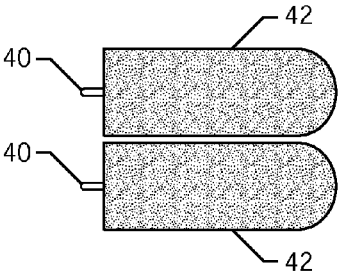
FIG. 9 is yet another top plan view similar to FIGS. 6-8, illustrating a further orientation of the roller arms.

FIGS. 6 through 9 illustrate the roller covers 42 in different orientations depending upon the relative positions of the roller arms 40. FIG. 6 shows the roller covers 42 in-line with one another, where the roller arms 40 are positioned at one hundred eighty degrees with respect to one another. FIG. 7 shows the roller covers 42 perpendicular to one another, where the roller arms 40 are positioned at ninety degrees with respect to one another. FIG. 8 shows the roller covers 42 obtuse to one another, where the roller arms 40 are positioned at about one hundred twenty degrees with respect to one another. FIG. 9 shows the roller covers 42 adjacent to one another, where the roller arms 40 are positioned at zero degrees with respect to one another.

The roller arms 40 are preferably fixed in their position with respect to the second ends 32*b*, 34*b* of the levers 32, 34, i.e., not extendable or retractable. However in an alternate embodiment, the roller arms 40 may be extendable and retractable along the longitudinal axis of the levers 32, 34. The extension/retraction of the roller arms 40 may be selectively fixed by the pivot locks 48, in a similar manner that the pivot locks 48 fix the angle of rotation.

Figure 10:
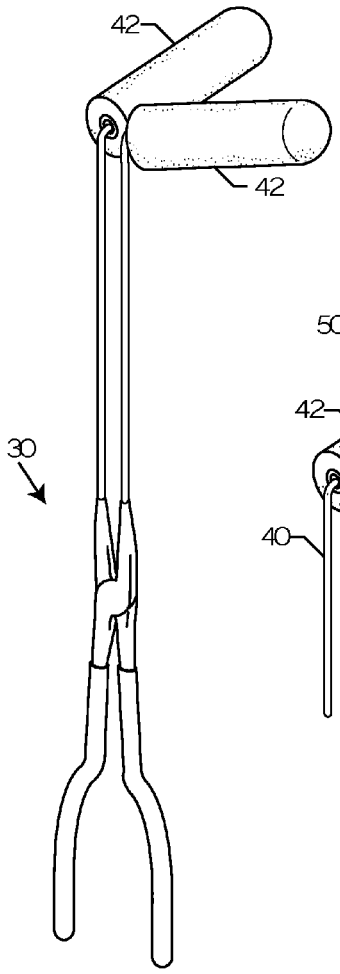
FIG. 10 is a perspective view of the improved dual paint roller frame similar to FIG. 1, showing the roller arms positioned at an angle as illustrated in FIG. 7.
Figure 11:
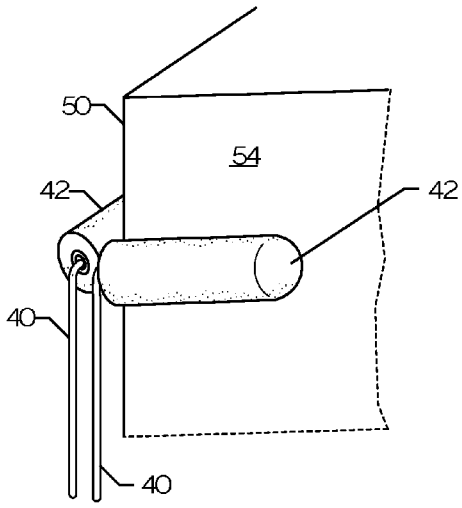
FIG. 11 is an environmental view illustrating the improved dual paint roller frame of FIG. 10 painting the corner of a wall.
Figure 12:
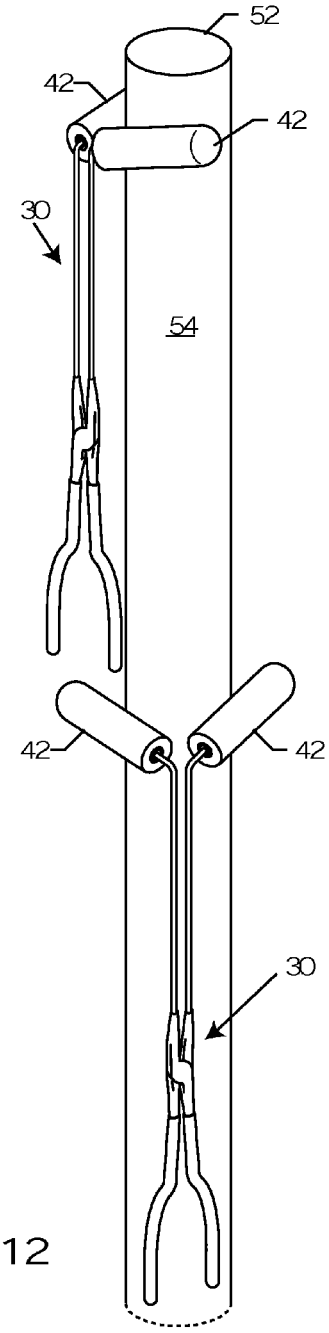
FIG. 12 is an environmental view illustrating the improved dual paint roller frame of FIG. 10 painting the a round pillar.

The rotatable nature of the roller arms 40 allows for the improved dual paint roller frame 30 to be used to more conveniently paint certain types of surfaces. With the roller arms 40 in a perpendicular orientation (FIG. 10), the improved dual paint roller frame 30 may be used to paint an external (convex) wall corner 50 (FIG. 11) or another corner of a different angle (not shown). In addition, the improved dual paint roller frame 30 of FIG. 11 may be reversed to paint an internal (concave) wall corner (not shown). The improved dual paint roller frame 30 with roller arms 40 in a similar orientation may also be used to paint a generally round pillar 52 or similar structure (FIG. 12). By using the improved dual paint roller frame 30, a painter may more quickly and more easily paint multiple adjoining or adjacent surfaces such as a corner 50 or pillar 52. In this configuration, the roller arms 40 are preferably maintained close to one another rather than apart. If the roller arms 40 are moved apart while in a perpendicular orientation, the paths followed by each roller cover 42 will diverge as it is rolled out. Such divergence will result in smudging or smearing of the paint on the surface as the roller covers 42 attempt to follow the divergent paths. However, smudging and smearing can be avoided by using the roller cover lock, as described below.

Figure 13:
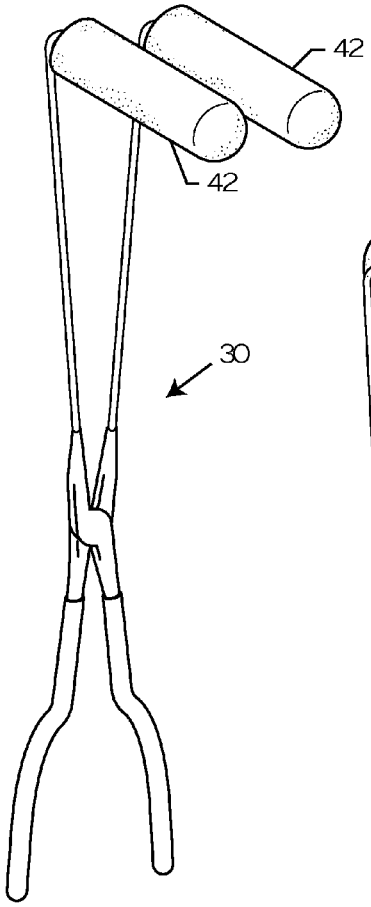
FIG. 13 is a perspective view of the improved dual paint roller frame similar to FIG. 1, showing the roller arms positioned parallel to each other as illustrated in FIG. 9.
Figure 14:
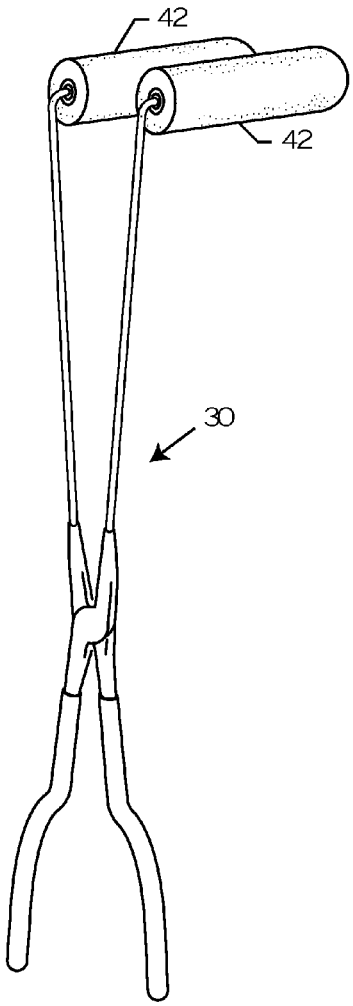
FIG. 14 is a perspective view illustrating of the improved dual paint roller frame as in FIG. 13.
Figure 15:
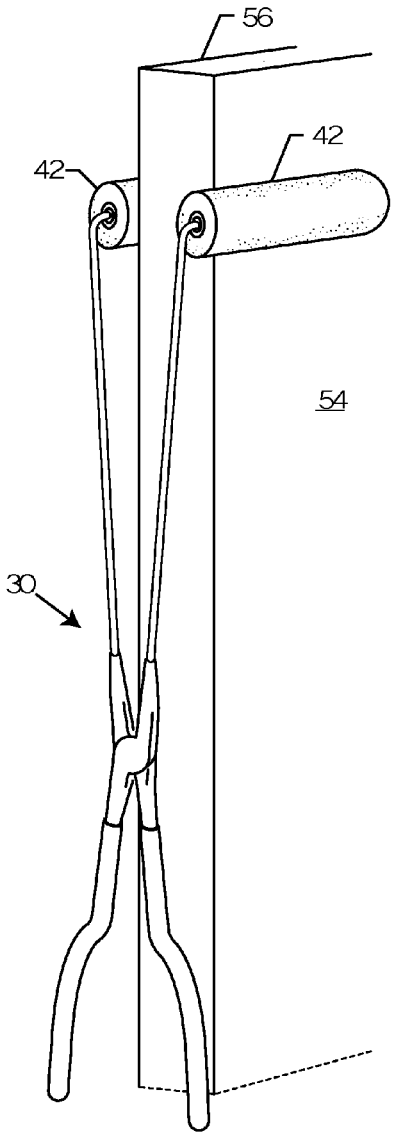
FIG. 15 is an environmental view illustrating the improved dual paint roller frame of FIGS. 13 and 14 painting opposite surfaces of a narrow wall or door.
Figure 16:
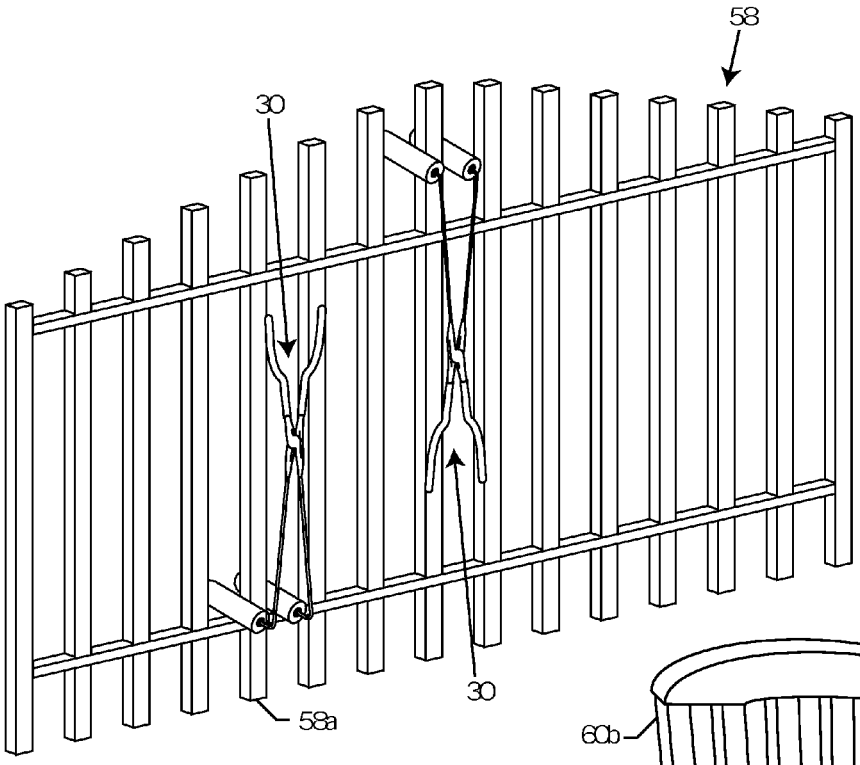
FIG. 16 is an environmental view illustrating the improved dual paint roller frame of FIGS. 13 and 14 painting the pickets of a fence.
Figure 17:
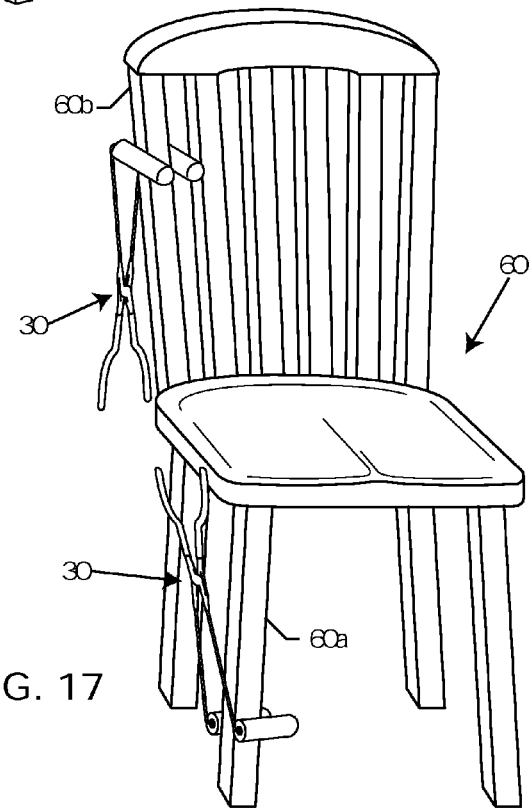
FIG. 17 is an environmental view illustrating the improved dual paint roller frame of FIGS. 13 and 14 painting the legs and back slats of a chair.
Figure 18:
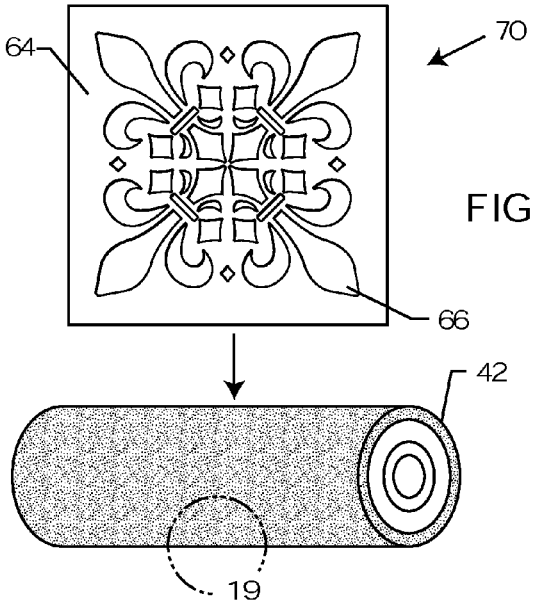
FIG. 18 is a perspective view illustrating a stencil tube pattern adjacent to a roller cover.
Figure 19:
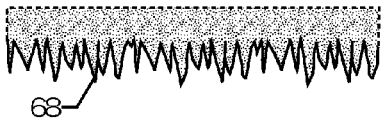
FIG. 19 is a close-up view of the area indicated by line 19 in FIG. 18, showing the knap of the roller cover.
Figure 20:
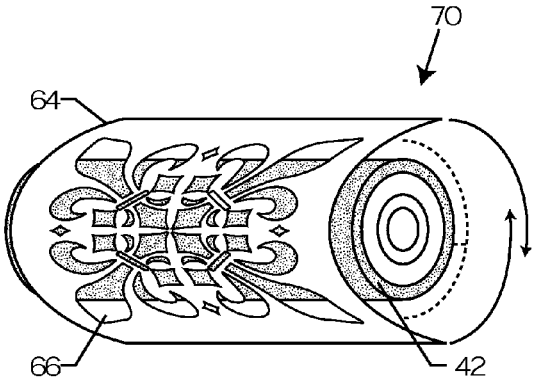
FIG. 20 is a perspective view illustrating a stencil tube pattern being applied to a roller cover.
Figure 21:
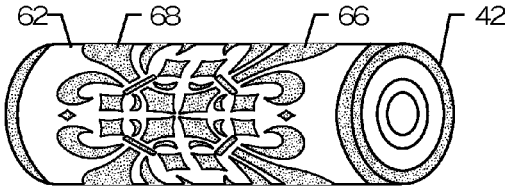
FIG. 21 is a perspective view illustrating a stencil tube pattern after being applied to a roller cover.
Figure 22:
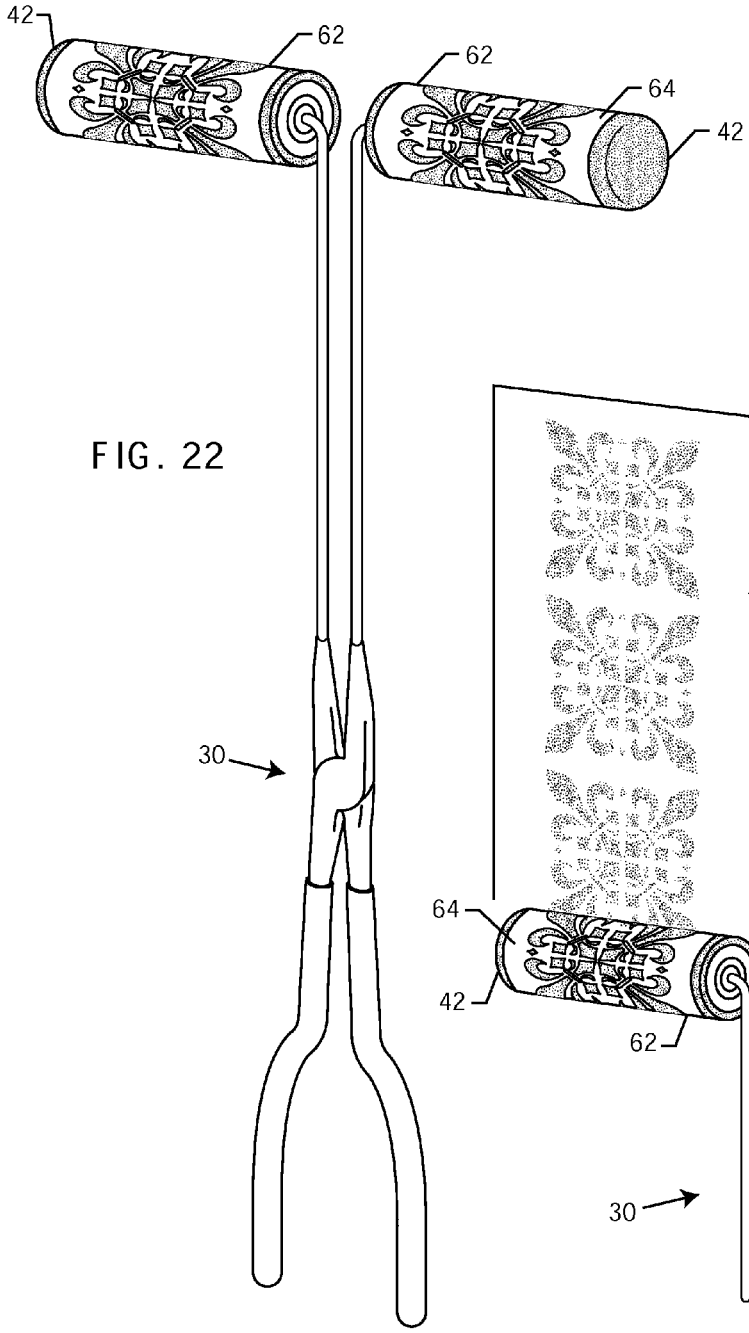
FIG. 22 is a perspective view of the improved dual paint roller frame illustrating a stencil tube pattern on each of the roller covers.

In another configuration, the roller arms 40 may be positioned parallel or adjacent to one another (FIGS. 13 and 14). In this configuration, the improved dual paint roller 30 may be used to paint opposite surfaces 54 of a wall or door 56 (FIG. 15). Because of the relative orientations of the roller arms 40 and roller covers 42, it is possible to accommodate a wall/door 56 of varying thicknesses by moving the roller arms 40 farther apart. By properly engaging the handles 38, the roller arms 40 may be brought closer together with sufficient force to properly apply paint to the surface 54. This same orientation can be used to paint the pickets 58*a* of a fence 58 (FIG. 16), as well as, the legs 60*a* or back slats 60*b* of a chair 60. A person skilled in the art will realize the myriad of applications (i.e., various surfaces) to which the improved dual paint roller 30 of the present invention can be applied and the benefits that arise therefrom.

In conjunction with the improved dual paint roller frame 30 described herein, the inventor has also invented a stencil tube 62 to be used with a roller cover 42, as generally illustrated in FIGS. 18 through 25. The stencil tube 62 comprises an elongated hollow tube defined by a tube wall 64 and made out of a non-absorbent material such as plastic or laminated paper. The tube 62 preferably has a diameter corresponding to or approximating the diameter of the roller cover 42. The wall 64 of the tube 62 includes an opening 66 that is in the shape or form of a pattern to be painted using the improved paint roller frame 30 and stencil tube 62. The opening 66 may be formed in any number of varying patterns that are used on prior art stencil patterns such as letters, numbers, shapes, or any combination thereof. Typically, the remaining portions of the wall 64 that have not been removed to form the opening 66 form a negative image of the pattern to be painted.

The opening 66 and knap 68 of the roller cover 42 are preferably configured such that a sufficient portion of the knap 68 protrudes through the opening 66 to absorb and apply paint when in use. A person using the stencil tube 62 may use tape or other similar adhesive to "pull" the knap 68 through the opening 66. Obviously, roller covers 42 with a longer knap 66, i.e., mohair or similar, will function better than a roller cover 42 with a shorter knap 66, i.e., foam. The stencil tube 62 may comprise a pre-formed tube (FIG. 24) which may be slid onto the roller cover 42 from one end thereof. Alternatively, the stencil tube 62 may begin as a generally flat card 70 (FIG. 18) which is then wrapped around a roller cover 42 to form the tube 62.

Figure 23:
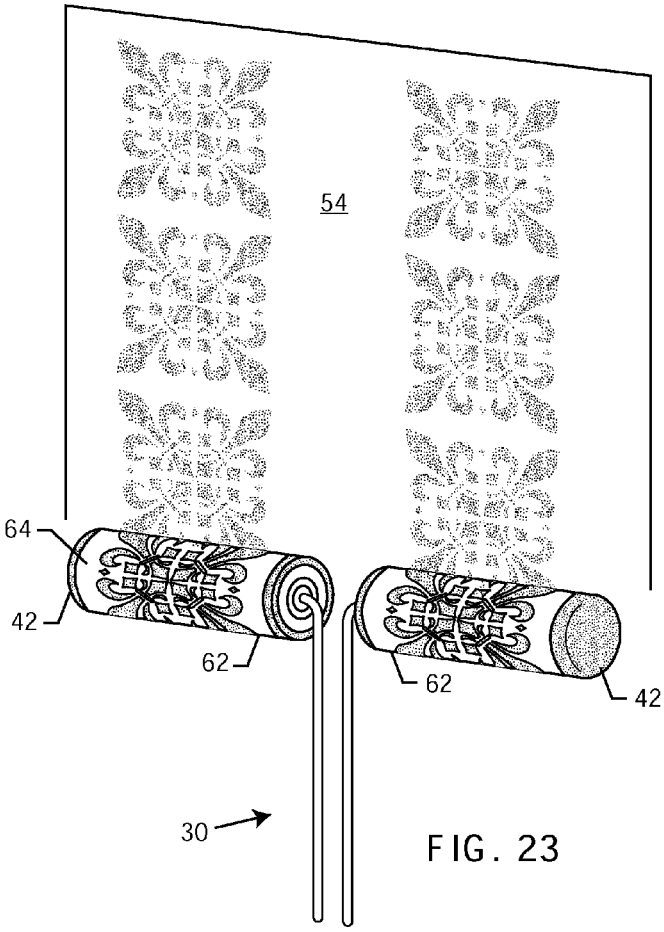
FIG. 23 is an environmental view illustrating the improved dual paint roller frame and stencil tube patterns of a preferred embodiment of the present invention applying a pattern to a wall surface.
Figure 24:
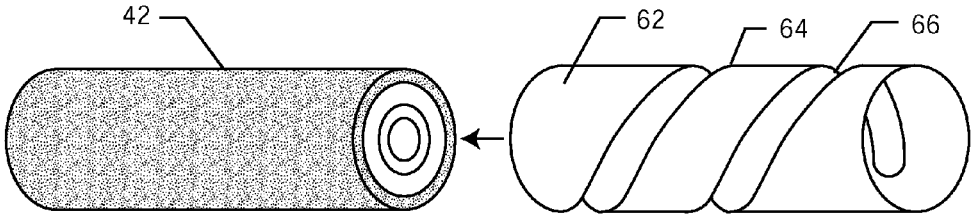
FIG. 24 is a perspective view illustrating a stencil tube pattern being applied to a roller cover.
Figure 25:
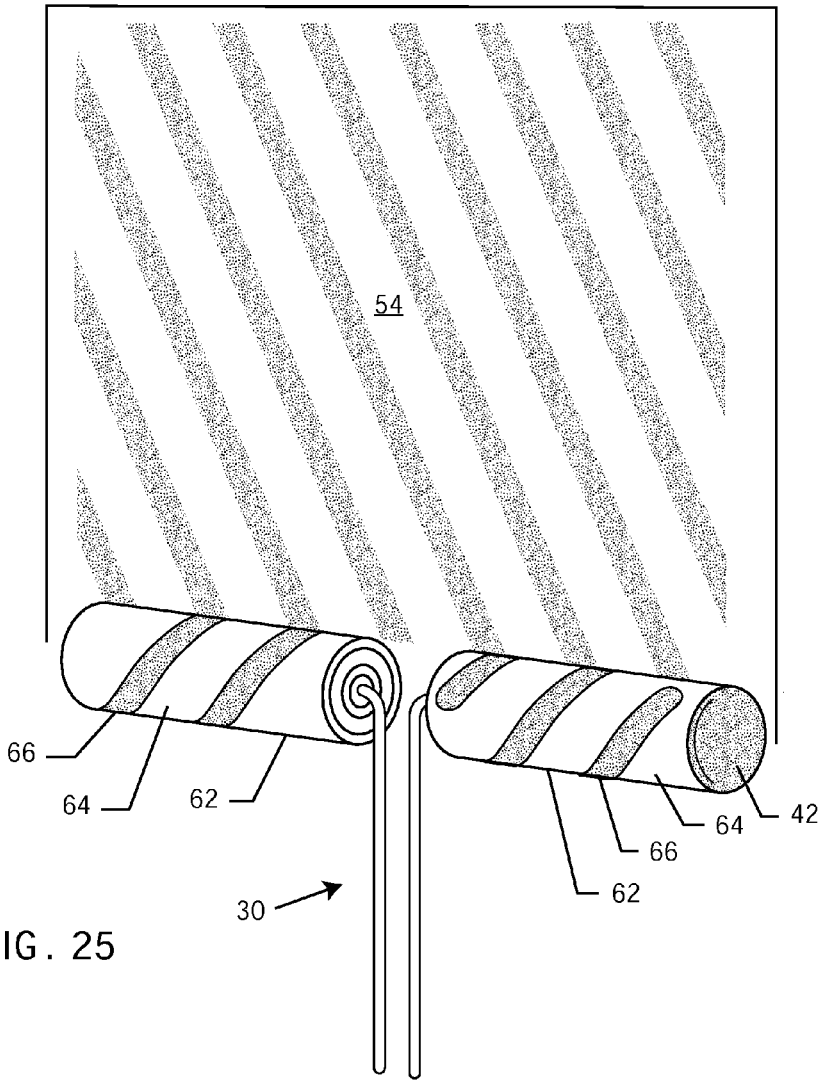
FIG. 25 is an environmental view illustrating the improved dual paint roller frame and stencil tube patterns of the improved dual paint roller frame applying a pattern to a wall surface.

The stencil tube 62 may be used in conjunction with the improved dual paint roller frame 30 or any prior art paint roller, such as those having a single roller cover. FIGS. 22 through 25 show the stencil tube 62 in use with roller covers 42 of the improved dual paint roller frame 30. As illustrated in FIGS. 23 and 25, the opening 66 on the stencil tube 62 applies the pattern to a surface in a reliable and repeatable manner with consistent spacing. With prior art stencils, a person would have to position a stencil pattern on a surface, apply paint and then reposition to stencil pattern at another spot on the surface to repeat the pattern.

Figure 26:
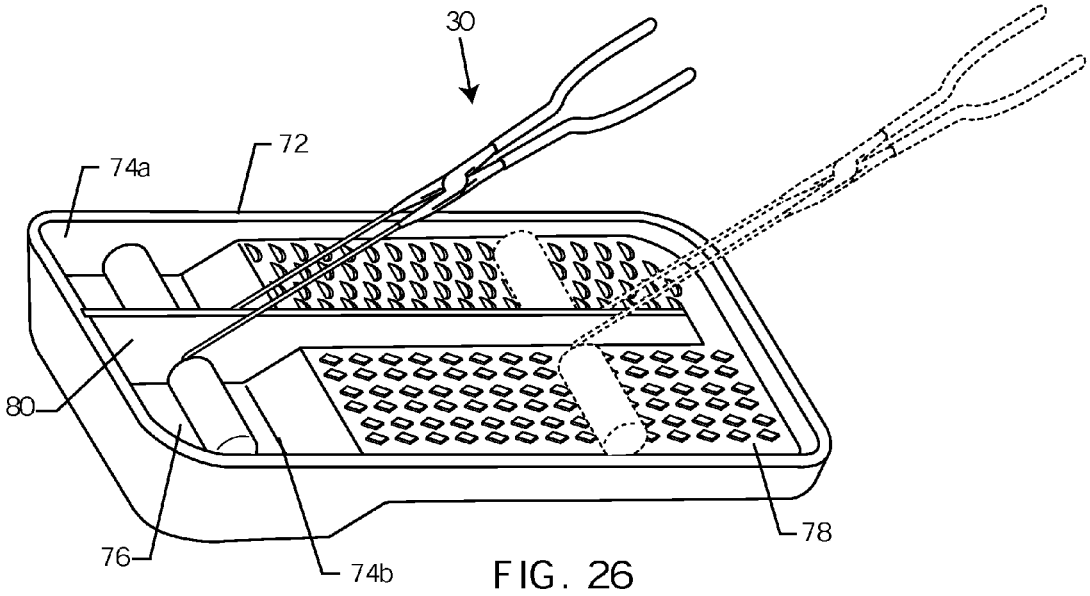
FIG. 26 is a perspective view illustrating a combination paint roller and paint tray.
Figure 27:
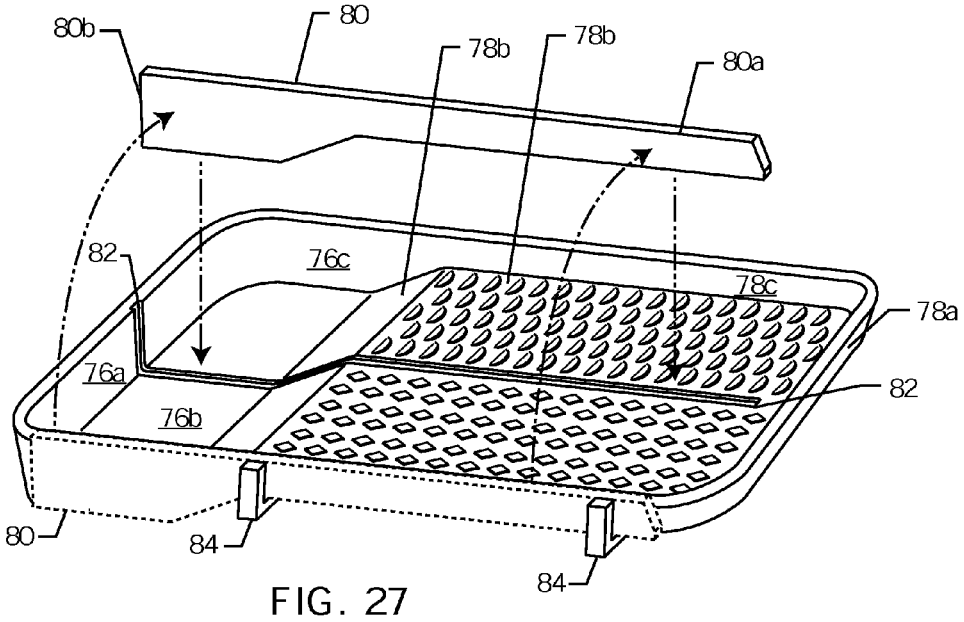
FIG. 27 is an exploded perspective view illustrating the removability of the paint tray divider.
Figure 28:
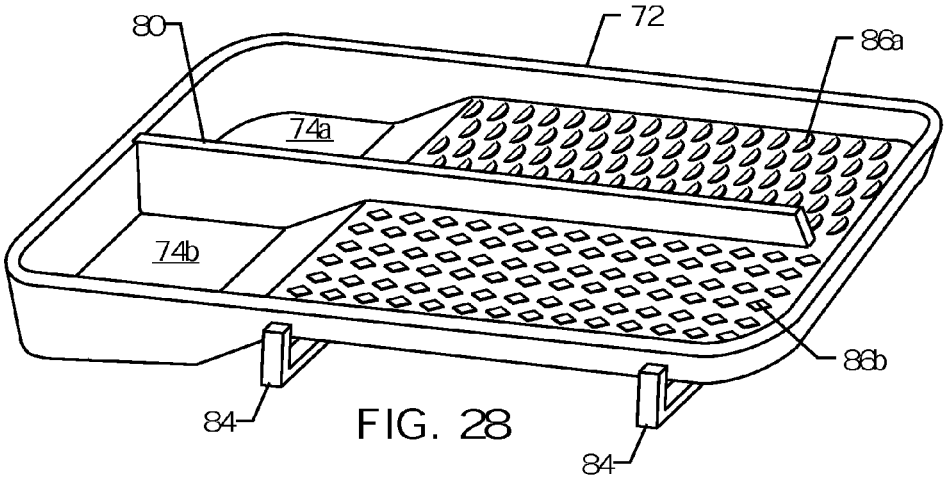
FIG. 28 is a perspective view illustrating the holder for the paint tray divider.

In combination with the improved dual paint roller frame 30, a paint tray 72 is also included in the present invention. The paint tray 72 includes two separate paint receptacles 74*a*, 74*b*. The receptacles 74*a*, 74*b* are configured to simultaneously receive the roller covers 42 of the improved dual paint roller frame 30, as shown in FIG. 26. The paint tray 72 comprises a deep end 76 and a shallow end 78. The deep end 66 is enclosed by a back wall 76*a*, a bottom wall 76*b*, and side walls 76*c*. The shallow end 78 is enclosed by a front wall 78*a*, an inclined bottom wall 78*b* and side walls 78*c*. The inclined bottom wall 78*b* slopes from the shallow end 78 to the deep end 76.

A divider 80 is disposed between the first and second receptacles 74*a*, 74*b*. The divider may be permanently affixed within the paint tray 72. In a particularly preferred embodiment, the divider 80 is removably disposed or "snapped" into a channel 82 that runs down the approximate center of the paint tray 72. The channel 82 runs along the back wall 76*a*, the bottom wall 76*b*, and at least a portion of the inclined bottom wall 78*b*. The divider 80 and channel 82 are configured such that the divider 80 is securely held in the channel 82 such that the first and second receptacles 74*a*, 74*b* are completely separated when the divider 80 is in position. Completely separating the first and second receptacles 74*a*, 74*b* allows for different colors or types of paint to be used in each receptacle 74*a*, 74*b* while maintaining their purity, i.e., they are not mixed. When the divider 80 is removed from the channel 82, it may be stored in a holder 84 positioned on the side of the paint tray 72. The divider 80 may also include a handle 80*a* and a spatula tool 80*b*, which can be used as a person of ordinary skill in the art would use a spatula tool.

The receptacles 74*a*, 74*b* preferably include patterns 86*a*, 86*b* disposed on the inclined bottom wall 78*b*. The patterns 86*a*, 86*b* may be same or may be different as illustrated. Different patterns 86*a*, 86*b* allow for different texturing of the paint on the roller covers 42. A person of ordinary skill in the art will appreciate the differences that result from the different texturing.

Figure 29:
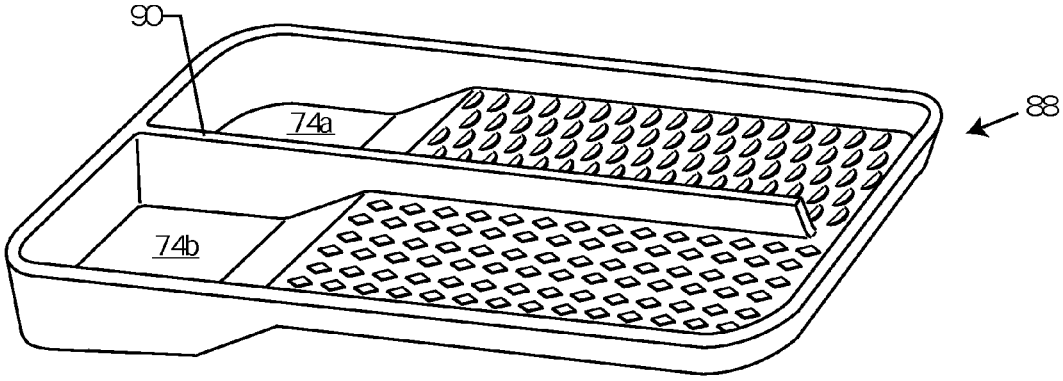
FIG. 29 is a perspective view illustrating the paint tray with a liner in place over the tray divider and paint receptacles.

The paint tray 72 may also comprise or come in the form of a paint tray liner 88 including two separate receptacles 74*a*, 74*b*, as illustrated in FIG. 29. The liner 88 is used to aid in quick cleanup. The liner 88 is configured to be disposed in the paint tray 72 or a prior art paint tray so as to create the first and second receptacles 74*a*, 74*b*. The liner 88 is preferably manufactured from light-weight plastic as with known prior art tray liners and includes a permanently affixed divider 90. In another embodiment, the liner 88 may be manufactured to cover just one or the other receptacle.

Figure 30:
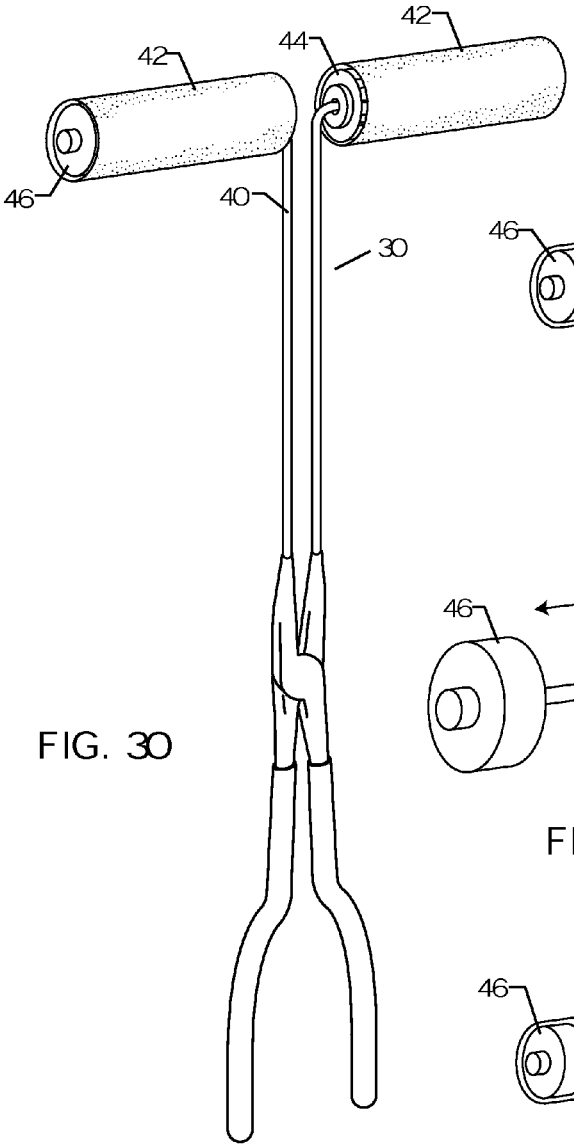
FIG. 30 is a perspective view similar to FIG. 1, illustrating another preferred form of the invention, wherein the improved dual paint roller frame has an end cap and an adjustable roller cover lock.

A particularly preferred embodiment of the improved dual paint roller frame 30 is illustrated in FIGS. 30-43. In FIG. 30, the improved dual paint roller frame 30 is fitted with a rotatable roller cover lock 44, a roller cover 42, and an end cap 46. The rotatable roller cover lock 44 is positioned on the roller arm 40 before the roller cover 42 is positioned on the roller arm 40. The roller cover lock 44 remains rotatable around the roller arm 40, but is slidable along the length of the roller arm 40. The rotatable roller cover lock 44 is sized to fit tightly within the interior of the roller cover 42 and serves to keep the roller cover 42 in place on the roller arm 40. The rotatable roller cover lock 44 also serves to keep the end of the roller cover 42 from collapsing against the roller arm 40. With the rotatable roller cover lock 44 in place, the improved dual paint roller frame 30 can be utilized without worry that the roller covers will edge their way off the roller arms 40.

Figure 31:
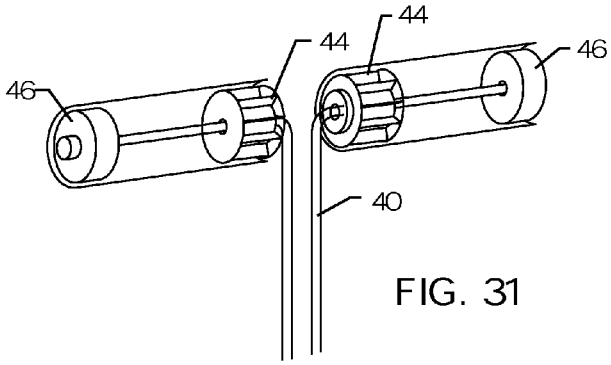
FIG. 31 is a close-up view of the roller arms and same-sized roller covers cut away to illustrate the placement of the roller cover lock and end cap.
Figure 32:
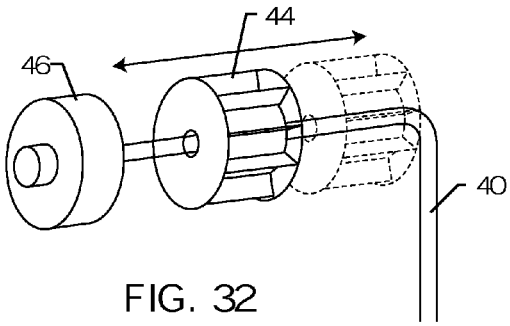
FIG. 32 illustrates the direction of movement for the roller cover lock.
Figure 33:
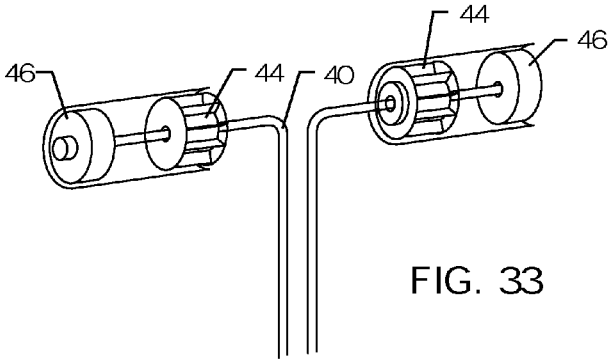
FIG. 33 illustrates the roller cover lock's use in combination with a shorter roller cover.

FIGS. 30-33 also illustrate an end cap 46 fitted on the roller arm 40 of the improved dual roller paint frame 30. The end cap 46 is sized to fit tightly within the interior of the roller cover 42 and is removably mounted adjacent to the roller cover at the end of the roller arm 40. FIGS. 31-33 show the placement of the rotatable roller cover lock 44 and end cap 46 within the roller cover 42. The rotatable roller cover lock 44 and the end cap 46 fit within the roller cover such that the roller cover will not slide off during use of the improved dual roller 30. The tight fight therein is not so tight, however, that the roller cover 42 is permanently retained on the roller arm 40 by the roller cover lock 44 and the end cap 46. Rather, once a different roller cover 42 is desired, the end cap 46 is removed from the end of the roller arm 40, the older roller cover 42 is pulled off of both the rotatable roller cover lock 44 and the end cap 46. The new roller cover 42 is pushed onto the rotatable roller cover lock 44, and the end cap is removably mounted to the end of the roller arm 40 adjacent to the roller cover 42. FIG. 32 illustrates how the rotatable roller cover lock 44 can slide along the length of the roller arm 40, while the end cap 46 remains stationary at the end of the roller arm 40. This means that the improved dual paint roller frame 30 can accommodate roller covers of different sizes. FIG. 33 shows the rotatable roller cover lock 44 and end cap 46 in use with a smaller roller cover 42. The rotatable roller cover lock 44 and end cap 46 in combination can be used with roller covers 42 of different lengths and circumferences.

Figure 34:
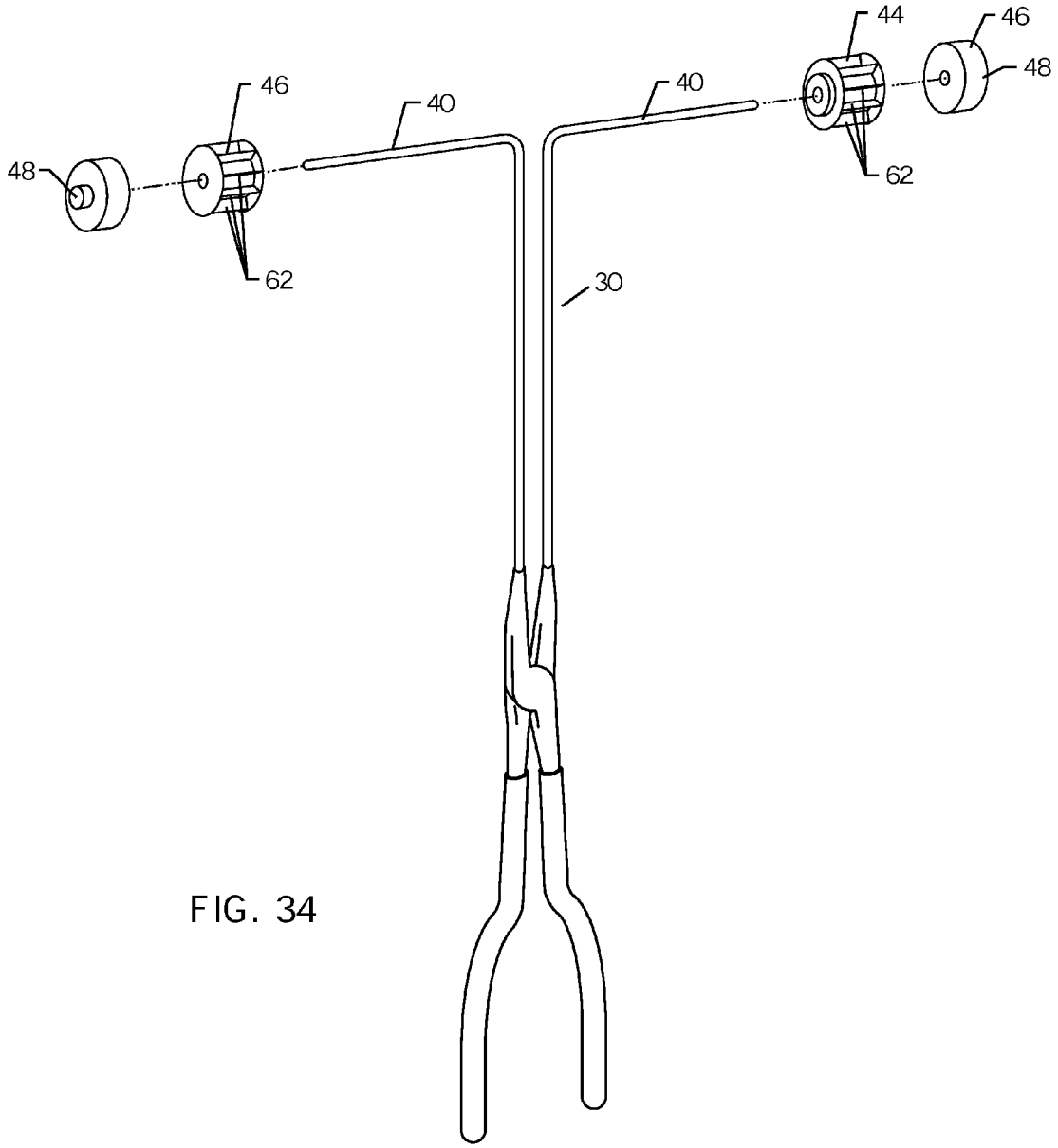
FIG. 34 is an exploded perspective view of the improved dual paint roller frame of FIG. 30 showing the preferred placement of the roller cover lock and end cap.

FIG. 34 shows the rotatable roller cover lock 44, end cap 46 and roller cover 42 in combination with the improved dual roller paint frame 30. While the roller cover lock 44 is slidable along the length of the roller arm 40, the end cap 46 is removably attached to the end of the roller arm 40 via a screw, clip, or clamp (not shown) through its central axis 48. When the end cap 46 is thus attached, it is still rotatable within the roller cover 42, but it will not allow for the roller cover 42 to slide off the end of the roller arm 40.

Additionally, as seen in FIG. 34, the rotatable roller cover lock 44 also includes means for enhancing the tight fit 62 between the rotatable roller cover lock 44 and the roller cover 42. In the preferred embodiment, the means for enhancing the tight fit 62 are a series of fins extending outwardly from the center of the roller cover lock 44. The fins are made of a flexible material and extend slightly beyond the circumference of the roller cover lock 44. When the roller cover 42 is pushed over the roller cover lock 44, the fins serve to make the tight fit between the roller cover 42 and roller cover lock 44 even stronger. The means for enhancing the tight fit 62 may be flexible fins, gripping teeth, wires, padding, or any other type of flexible member that would serve this purpose.

Figure 35:
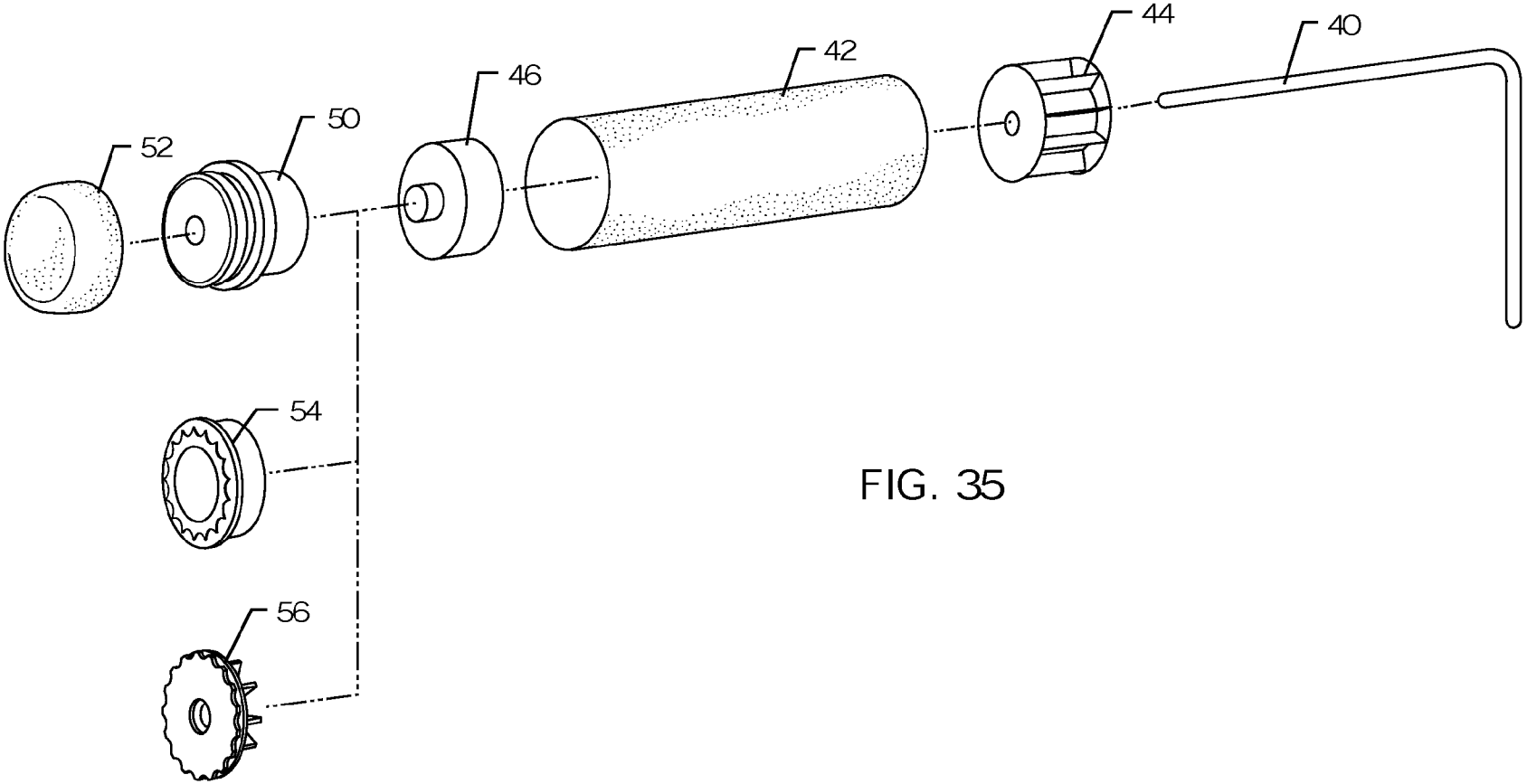
FIG. 35 is an enlarged, exploded perspective view, illustrating the selection of end caps available for use with the roller cover and roller cover lock.
Figure 36:
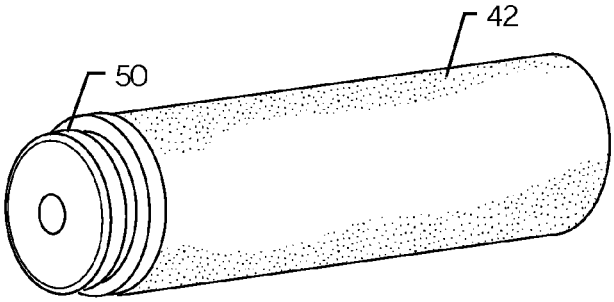
FIG. 36 is a perspective view of a smooth disk end cap fitted to the roller cover.

The end cap 46 can be configured in many ways. As shown in FIG. 35, the end cap 46 can be a disk with a protrusion. Alternate embodiments are also shown. The end cap can be a smooth disk 50 alone, or mounted with an absorbent covering 52. Alternately, the end cap can be notched disk 54 or an adjustable length roller guide 56. As described above, the end cap 46 is removably mounted on the end of the roller arm 40 and remains rotatable within the roller cover 42. The end caps are interchangeable depending on the desired functionality.

Figure 37:
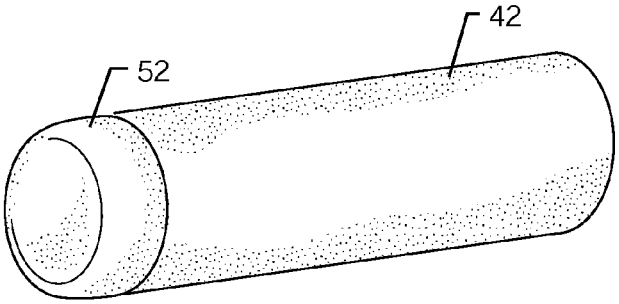
FIG. 37 is a perspective view of an absorbent covering end cap fitted to the roller cover.

Different end caps perform different functions. For example, in FIG. 36, the smooth disk 50 is fitted on the end of the roller cover 42. This end cap is appropriately used when the user is painting on a wall near a corner connected to a second wall. If the user does not want the paint from the first wall to accidentally be transferred onto the second wall, the smooth disk allows the roller cover 42 to remain biased away from the second wall without getting any paint on the second wall. If the user wants both the first and second walls to be painted the same color and desires to use the roller to paint all the way into the corner between the two walls, the absorbent covering 52 can be placed over the smooth disk 50, as shown in FIG. 37. The absorbent covering 52 is made of the same material as the roller cover 42, i.e., fabric, foam, lamb's wool or mohair.

Figure 38:
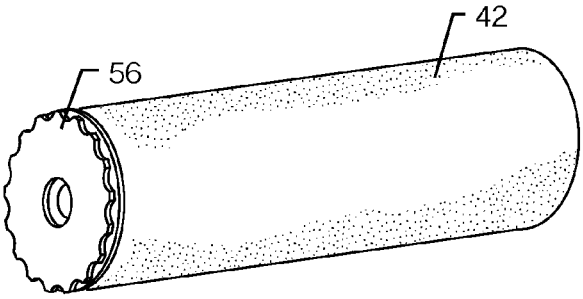
FIG. 38 is a perspective view of an adjustable length roller guide end cap fitted to the roller cover.
Figure 39:
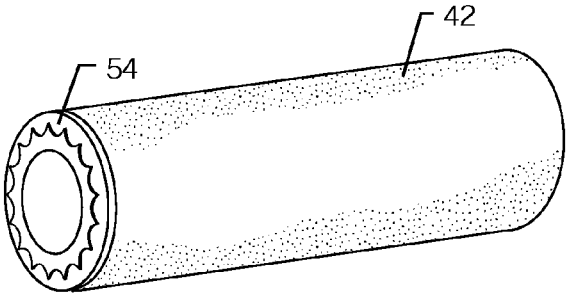
FIG. 39 is a perspective view of a notched disk end cap fitted to the roller cover.

Other options end cap options include a notched disk end cap 54, as in FIG. 39, or an adjustable length roller guide 56, as in FIG. 38. The notched disk end cap 54 allows the roller cover 42 to be biased a small distance away from any adjacent structure. The notches on the disk allow for the roller cover 42 to have extra traction against the surface over which it is being used.

Figure 40:
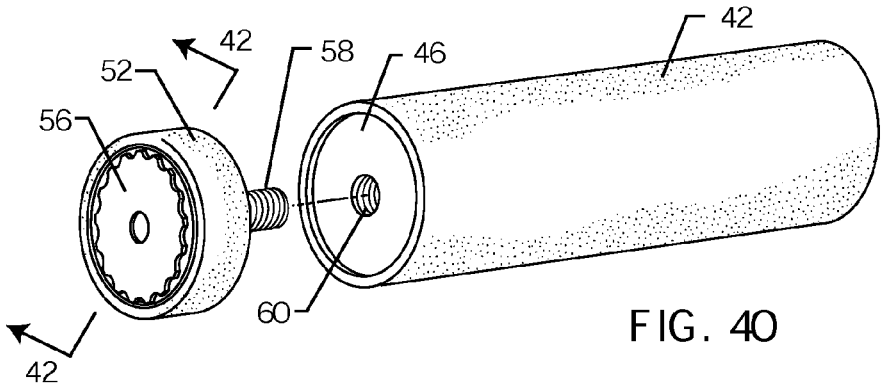
FIG. 40 is an exploded perspective view of the roller cover illustrating the adjustable length roller guide's placement in conjunction with the end cap.

FIGS. 40-43 illustrate the adjustable length roller guide 56. As shown in FIG. 40, the adjustable length roller guide 56 can be used in combination with the absorbent covering 52. In this configuration, the end cap 46 is threaded through the end of the roller cover 42. The end cap 46 is then screwed into the end of the roller arm 40 (not shown) via a screw 58 and interlocking ridges 60. Other means such as a clip, clamp, or other removably attaching means can also be used.

Figure 41:
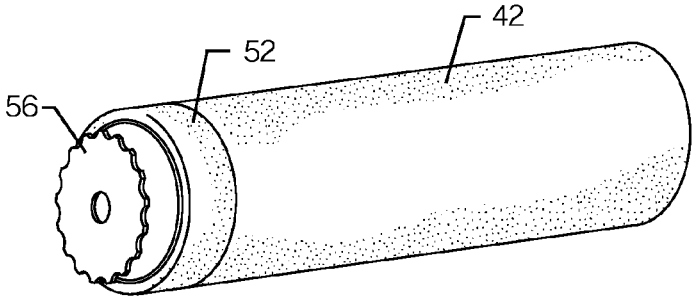
FIG. 41 is a perspective view of the roller cover of FIG. 40, illustrating the adjustable length roller guide in use once attached to the end cap.
Figure 42:
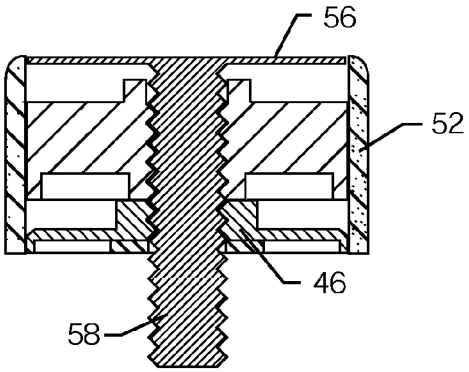
FIG. 42 is a sectional view taken along line 42-42 from FIG. 40, illustrating the placement of the inner screw when the roller guide is flush with the roller end cap.
Figure 43:
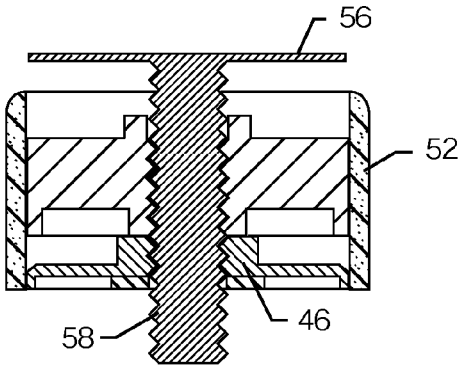
FIG. 43 is a sectional view similar to FIG. 42, illustrating the placement of the inner screw after the roller guide is extended away from the roller end cap.

Once, the end cap 46 is screwed into place, as in FIG. 41, the adjustable length roller guide 56 can be drawn out a desired distance away from the roller cover 42. This is accomplished by unscrewing the adjustable length roller guide 56 from the end cap. The screw 58 and interlocking ridges 60 allow for the adjustable length roller guide 56 to be unscrewed a certain distance from the end cap, and to remain at that distance while the dual-roller paint roller 30 is in use. The length of the screw 58 allows for the end cap 46 to remain attached to the end of the roller arm 40 even when the adjustable length roller guide 56 is biased a larger distance away from the roller cover 42. This is useful if the improved dual roller paint frame is being used to paint an area of wall adjacent to a crown molding, window casement, or other area that is not being painted. The adjustable length roller guide 56 is drawn out a desired distance from the roller cover 42. The adjustable length roller guide 56 can then run along the crown molding, window casement, or etc. while the area adjacent is being painted without fear of getting paint on an undesired spot.

Although several embodiments have been described in detail for purposes of illustration, various modifications may be made without departing from the scope and spirit of the invention. Accordingly, the invention is not to be limited, except as by the appended claims.

What is claimed is:

1. A dual roller paint frame, comprising:

a first lever having a first handle disposed at a first end thereof and a first roller arm extending from a second end thereof;

a second lever pivotally connected to the first lever and having a second handle disposed at a first end thereof and a second roller arm extending from a second end thereof, wherein the roller arms are independently pivotable about longitudinal axes of the respective first and second levers;

a pivot lock on the second end of each of the first and second levers, wherein each of the pivot locks firmly hold one of the roller arms on either the first or second lever at a selected angle of rotation;

at least one rotatable roller cover lock slidably mounted on at least one of the first or the second roller arms; and a roller cover mounted to the at least one of the first or the second roller arms and removably attached to the roller cover lock.

2. The dual roller paint frame of claim 1, further comprising an end cap removably mounted adjacent to the roller cover.

3. The dual roller paint frame of claim 2, wherein the end cap comprises an adjustable length roller guide.

4. The dual roller paint frame of claim 1, wherein the roller cover comprises an absorbent material.

5. The dual roller paint frame of claim 4, where in the absorbent material includes fabric, foam, lamb's wool or mohair.

6. The dual roller paint frame of claim 1, wherein the roller-cover lock is sized to create a tight fit with an interior of the roller cover.

7. The dual roller paint frame of claim 6, wherein the roller cover lock includes means for enhancing the tight fit with the interior of the roller cover.

8. The dual roller paint frame of claim 7, wherein the means for enhancing the tight fit includes fins or gripping teeth extending from the outer diameter of the roller cover lock.

9. The dual roller paint frame of claim 1, wherein each of the roller arms are independently pivotable through a range of zero degrees to ninety degrees.

10. The dual roller paint frame of claim 1, wherein the roller arms are independently extendable along the longitudinal axes of the respective first and second levers.

11. The dual roller paint frame of claim 1, wherein the first and second levers each comprise a first portion corresponding to the first end and a second portion corresponding to the second end, the first and second portions functionally connected at a pivot point connecting the first lever to the second lever.

12. The dual roller paint frame of claim 11, further comprising a spring between the first portions of the first and second levers biasing the first portion of the first lever away from the first portion of the second lever.

13. The dual roller paint frame of claim 11, wherein the pivot point selectively allows for complementary or opposite movement of the first portion of each lever with respect to the second portion of each lever.

14. The dual roller paint frame of claim 13, further comprising a multi-position switch at the pivot point that switches the pivot point between complementary or opposite movement.

15. The dual roller paint frame of claim 1, in combination with a paint tray, the paint tray comprising:

a main paint well having a deep end and a shallow end, the shallow end having an inclined bottom wall that slopes down toward the deep end;

a channel disposed on back and bottom walls of the deep end and along an adjacent portion of the inclined bottom wall of the shallow end; and a divider configured to be selectively securable to an outside wall of the paint tray and inserted into the channel such that the divider securely engages the channel and divides the deep end and the adjacent portion of the shallow end into two separate receptacles.

16. The dual roller paint frame of claim 15, wherein one of each of the roller arms of a paint roller is dippable into one of the two separate receptacles.

17. The dual roller paint frame of claim 15, wherein the divider has a handle that functions as a spatula tool.

18. The dual roller paint frame of claim 15, wherein the inclined bottom wall has a first pattern in one of the two separate receptacles and a second pattern in the other of the two separate receptacles.

19. The dual roller paint frame of claim 15, further comprising a paint tray liner configured to be inserted in the main paint well, the paint tray liner including an integral divider that divides the deep end and the adjacent portion of the shallow end into two separate receptacles.

20. The dual roller paint frame of claim 1, in combination with a stencil tube disposed on at least one of the roller arms, the stencil tube comprising:

an elongated hollow tube configured for sliding engagement with a roller cover, wherein the elongated hollow tube is removable from the roller cover and comprises a non-absorbent material including plastic or laminated paper; and an opening through a wall of the elongated hollow tube such that a portion of the roller cover extends through the opening, wherein the elongated hollow tube forms a negative image of a pattern to be painted on a surface by the roller cover, the pattern comprising letters, numbers, shapes, or a combination thereof.

21. A dual roller paint frame, comprising:

a first lever having a first handle disposed at a first end thereof and a first roller arm extending from a second end thereof;

a second lever pivotally connected to the first lever and having a second handle disposed at a first end thereof and a second roller arm extending from a second end thereof, wherein the roller arms are independently pivotable about longitudinal axes of the respective first and second levers, and wherein the roller arms are independently extendable along the longitudinal axes of the respective first and second levers;

at least one rotatable roller cover lock slidably mounted on at least one of the first or the second roller arms; and a roller cover mounted to the at least one of the first or the second roller arms and removably attached to the roller cover lock.

22. A dual roller paint frame, comprising:

a first lever having a first handle disposed at a first end thereof and a first roller arm extending from a second end thereof;

a second lever pivotally connected to the first lever at a pivot point and having a second handle disposed at a first end thereof and a second roller arm extending from a second end thereof, wherein the first and second levers each comprise a first portion corresponding to the first end and a second portion corresponding to the second end, the first and second portions functionally connected at the pivot point, and wherein the pivot point selectively allows for complementary or opposite movement of the first portion of each lever with respect to the second portion of each lever;

at least one rotatable roller cover lock slidably mounted on at least one of the first or the second roller arms;

a roller cover mounted to the at least one of the first or the second roller arms and removably attached to the roller cover lock; and a multi-position switch at the pivot point that switches the pivot point between complementary or opposite movement.

23. The dual roller paint frame of claim 22, in combination with a paint tray, the paint tray comprising:

a main paint well having a deep end and a shallow end, the shallow end having an inclined bottom wall that slopes down toward the deep end;

a channel disposed on back and bottom walls of the deep end and along an adjacent portion of the inclined bottom wall of the shallow end; and a divider configured to be selectively securable to an outside wall of the paint tray and inserted into the channel such that the diver securely engages the channel and divides the deep end and the adjacent portion of the shall end into two separate receptacles.

* * * * *